US011225391B2

(12) United States Patent
Fukasawa et al.

(10) Patent No.: US 11,225,391 B2
(45) Date of Patent: Jan. 18, 2022

(54) SHEET FOLDING DEVICE WITH CONVEYING ROLLER CAPABLE OF PARTIALLY ROTATING AROUND FOLDING ROLLER

(71) Applicant: HEWLETT-PACKARD DEVELOPMENT COMPANY, L.P., Spring, TX (US)

(72) Inventors: Eiji Fukasawa, Suwon-si (KR); Jung-Kyu Park, Suwon-si (KR); Jae-Hyun Shin, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/734,531

(22) PCT Filed: Sep. 11, 2019

(86) PCT No.: PCT/US2019/050625
§ 371 (c)(1),
(2) Date: Dec. 2, 2020

(87) PCT Pub. No.: WO2020/056010
PCT Pub. Date: Mar. 19, 2020

(65) Prior Publication Data

US 2021/0229945 A1 Jul. 29, 2021

(30) Foreign Application Priority Data

Sep. 11, 2018 (KR) ..... 10-2018-0108420

(51) Int. Cl.
*B65H 45/16* (2006.01)
*B65H 29/12* (2006.01)

(52) U.S. Cl.
CPC ..... *B65H 45/16* (2013.01); *B65H 29/125* (2013.01); *B65H 2801/27* (2013.01)

(58) Field of Classification Search
None
See application file for complete search history.

(56) References Cited

U.S. PATENT DOCUMENTS 5,076,556 A * 12/1991 Mandel ..... B65H 45/144 270/45
5,092,833 A * 3/1992 King ..... B65H 45/18 493/424

(Continued)

FOREIGN PATENT DOCUMENTS

EP 0421547 A1 4/1991
JP 2001341937 A 12/2001

(Continued)

*Primary Examiner* — Leslie A Nicholson, III
(74) *Attorney, Agent, or Firm* — Conley Rose, P.C.

(57) ABSTRACT

A sheet folding device includes a folding path, a positioning member, a first folding roller, a second folding roller, a folding blade, a guide path, and a conveying roller. The positioning member is to support a leading edge of a sheet fed along the folding path and align the sheet at an initial folding position. The first folding roller is to engage with the second folding roller to form a folding nip. The folding blade is to move to an insertion position to push the sheet on the folding path into the folding nip. The guide path is provided around the first folding roller to return the sheet that has passed through the folding nip to the folding path. The conveying roller is to partially rotate around the first folding roller, to engage with the first folding roller to form a conveying nip and to feed the sheet along the guide path.

15 Claims, 10 Drawing Sheets

(56) References Cited

U.S. PATENT DOCUMENTS

| | | | | |
|---|---|---|---|---|
| 5,769,774 | A * | 6/1998 | Beck | B65H 45/144 493/419 |
| 5,980,444 | A | 11/1999 | Dickhoff | |
| 7,794,381 | B2 * | 9/2010 | Yamamoto | B65H 45/144 493/421 |
| 10,974,921 | B2 * | 4/2021 | Fukasawa | B65H 29/52 |
| 2009/0062097 | A1 | 3/2009 | Yamamoto et al. | |
| 2010/0304947 | A1 | 12/2010 | Itou | |
| 2011/0058876 | A1 | 3/2011 | Yasuda et al. | |

FOREIGN PATENT DOCUMENTS

| | | | |
|---|---|---|---|
| JP | 2005096990 | A | 4/2005 |
| JP | 2012214282 | A | 11/2012 |
| RU | 2586906 | C1 | 6/2016 |

* cited by examiner

SHEET FOLDING DEVICE WITH CONVEYING ROLLER CAPABLE OF PARTIALLY ROTATING AROUND FOLDING ROLLER

BACKGROUND

A sheet folding device folds a sheet-like medium (hereinafter, referred to as "sheet") into various forms. The sheet folding device may be employed in a finisher of sheets discharged from a copying machine, a printer, or the like, or may be a stand-alone device.

The sheet folding device may fold a sheet once or more than twice using a pair of folding rollers forming a folding nip. The sheet folding device feeds a sheet that has passed through the folding nip again to an entrance of the folding nip to fold the sheet more than once. A structure for feeding the sheet that has passed through the folding nip to the entrance of the folding nip for the next folding may vary. Sheet feeding accuracy between the entrance of the folding nip and an exit of the folding nip may affect precise sheet folding.

DETAILED DESCRIPTION

Figure 1:
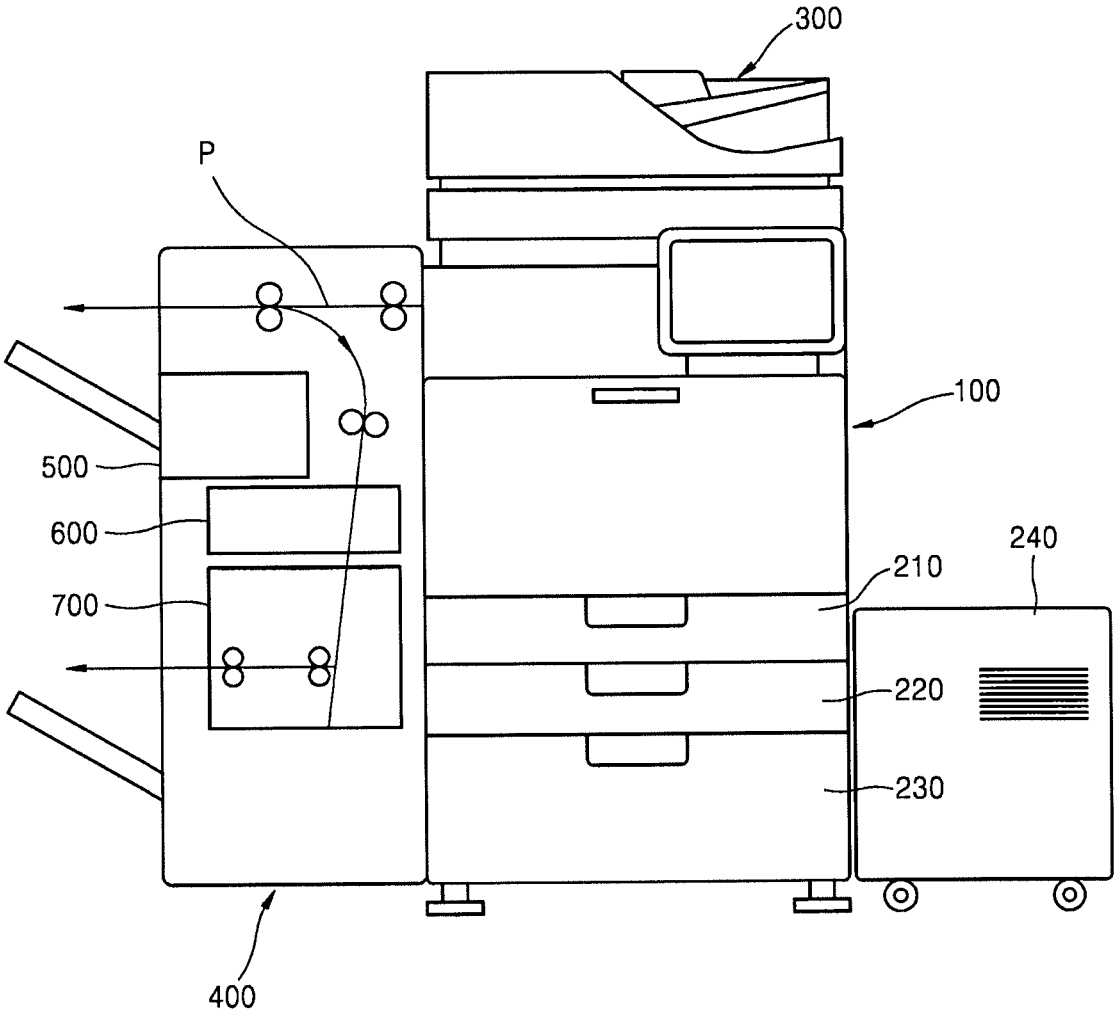
FIG. 1 is a configuration diagram of an example of an image forming device.

Hereinafter, examples of a sheet folding device and an image forming device using the same will be described with reference to the accompanying drawings. The same reference numerals refer to the same elements throughout. In the drawings, the sizes of constituent elements may be exaggerated for clarity.

FIG. 1 is a configuration diagram of an example of an image forming device. Referring to FIG. 1, the image forming device may include a printer 100 and a finisher 400. The printer 100 prints an image on a sheet-like medium (hereinafter, referred to as a sheet) supplied from a feeder. The feeder may include, for example, a main cassette feeder 210 located below the printer 100, a secondary cassette feeder 220 located below the main cassette feeder 210, a high capacity feeder 230 located below the main cassette feeder 210 or below the secondary cassette feeder 220, a high capacity feeder 240 located on the side of the printer 100, or the like. Although not shown in the drawings, the feeder may be a multi-purpose tray (MPT).

The printer 100 may print an image on a sheet P using any one of various printing methods, such as an electrophotographic method, an inkjet method, a thermal transfer method, and a thermal sublimation method. For example, the image forming device of the present example prints a color image on the sheet P using the electrophotographic method.

The image forming device may further include a scanner 300 for reading an image recorded on a document. The scanner 300 may have various structures such as a flatbed structure in which a document is located at a fixed position and a reading member moves to read an image, a document feed structure in which the reading member is located at a fixed position and the document is fed, or a combination structure thereof.

The finisher 400 may include a sheet folding device 700 that folds the sheet P discharged from the printer 100 once or more. The finisher 400 may further include an aligner 500 for aligning the sheet P discharged from the printer 100. The aligner 500 may have a structure capable of stapling or punching a staple at an end of the sheet P. The finisher 400 may further include a middle stapler 600 for stapling a staple at a central portion of the sheet P.

Hereinafter, examples of the sheet folding device 700 will be described in detail.

Figure 2:
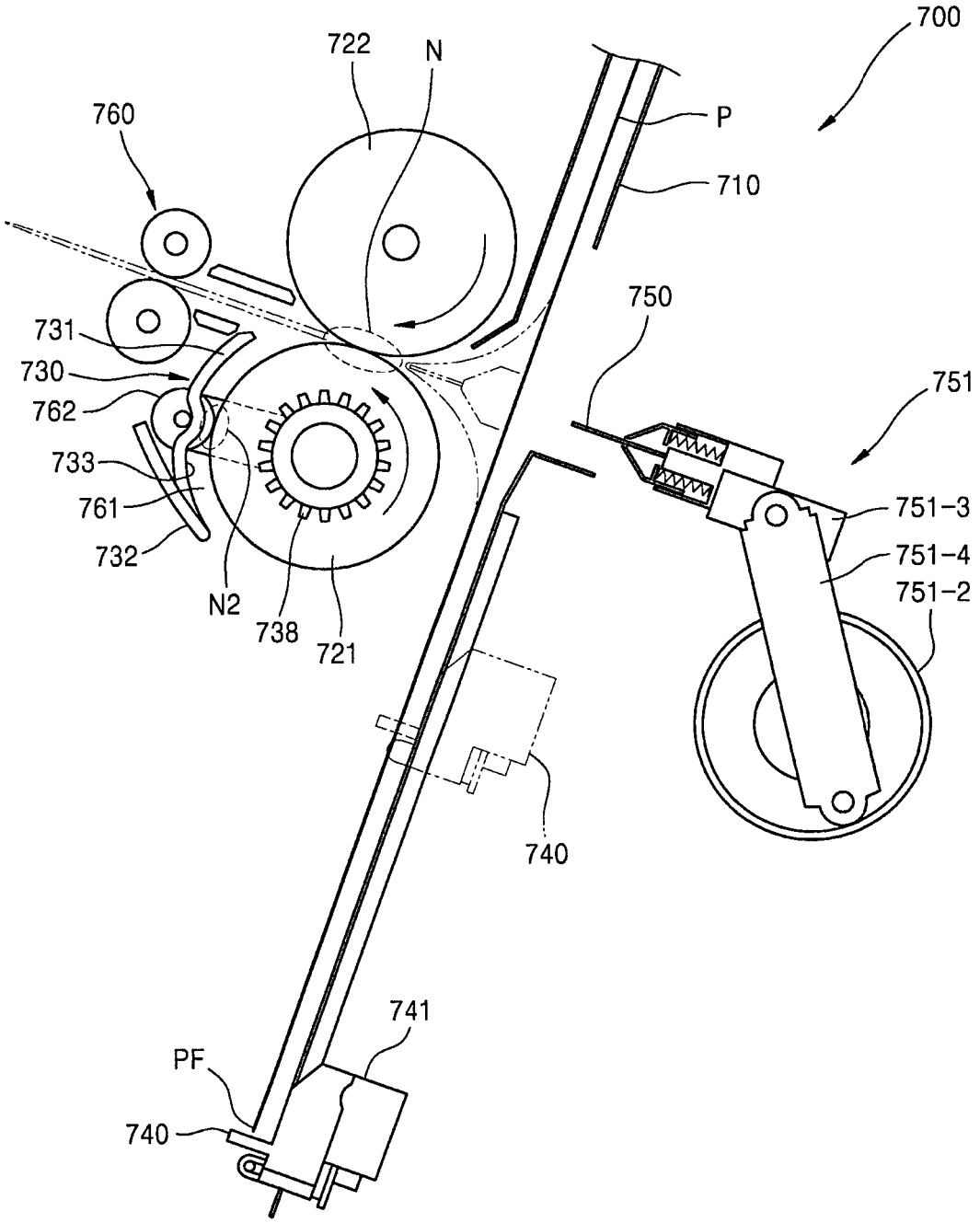
FIG. 2 is a configuration diagram of an example of a sheet folding device, showing a state in which a folding blade is located at a retreat position.
Figure 3:
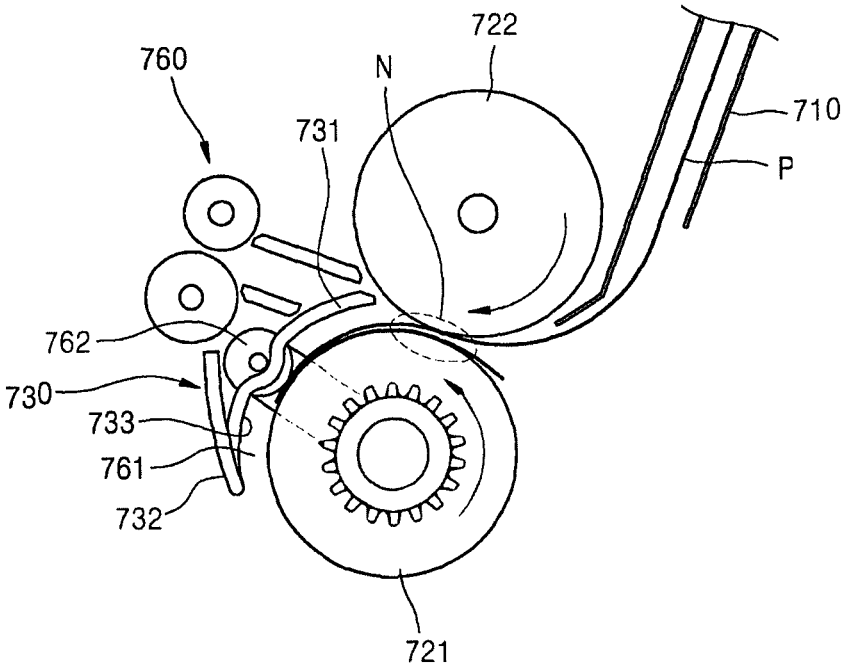
FIG. 3 is a view showing a state in which a guide member is located at a second position in an example of the sheet folding device shown in FIG. 2.
Figure 4:
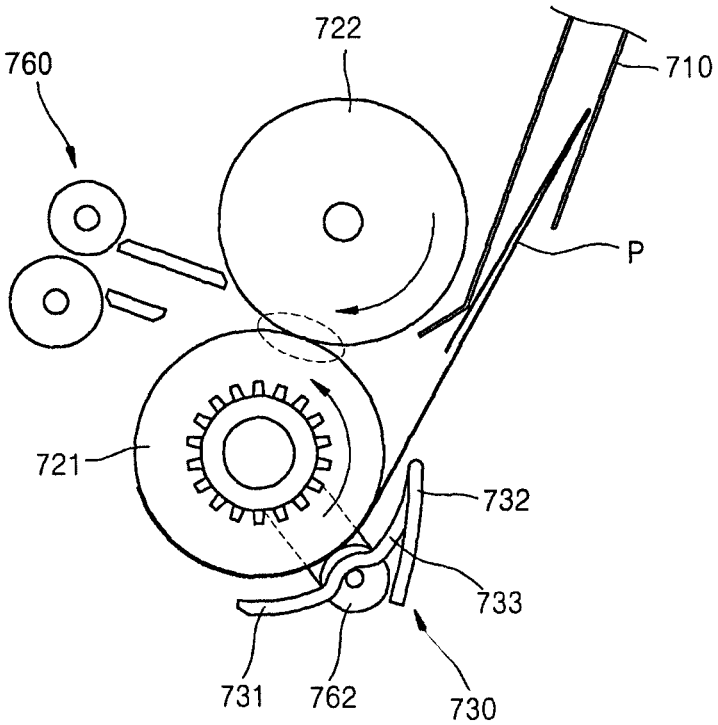
FIG. 4 is a view showing a state in which a guide member is located at a third position in an example of the sheet folding device shown in FIG. 2.
Figure 5:
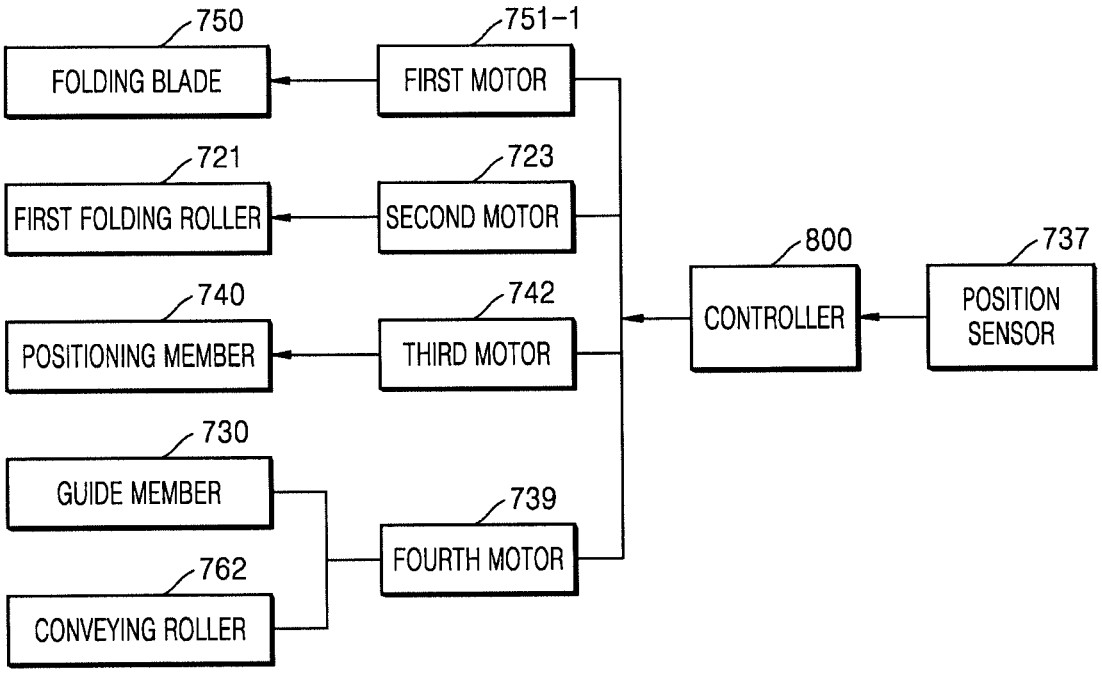
FIG. 5 is a block diagram of an example of the sheet folding device shown in FIG. 2.

FIG. 2 is a configuration diagram of an example of the sheet folding device 700, showing a state in which a folding blade 750 is located at a retreat position. FIG. 3 is a view showing a state in which a guide member 730 is located at a second position. FIG. 4 is a view showing a state in which the guide member 730 is located at a third position. FIG. 5 is a block diagram of an example of the sheet folding device 700.

Referring to FIG. 2, the sheet folding device 700 may include a folding path 710, a positioning member 740, a first folding roller 721, a second folding roller 722, the folding blade 750, a guide path 761, and a conveying roller 762.

The pair of folding rollers is located in the folding path 710. The pair of folding rollers may include the first and second folding rollers 721 and 722 which are engaged with each other as the first folding roller is to engage with the second folding roller to form a folding nip N. The first folding roller 721 is located on the downstream side and the second folding roller 722 is located on the upstream side with respect to the folding path 710. A second motor 723 rotates the first and second folding rollers 721 and 722. A controller 800 controls the sheet folding device 700. The controller 800 may rotate the first and second folding rollers 721 and 722 by driving the second motor 723.

The folding blade 750 is located on an entrance side of the folding nip N. The folding blade 750 may be moved to an insertion position (dashed lines in FIG. 2) for pushing the sheet P on the folding path 710 into the folding nip N and a retreat position (solid lines in FIG. 2) that is escaped from the folding path 710. The folding blade 750 pushes a portion to be folded between a leading edge and a trailing edge of the sheet P into the folding nip N. The folding blade 750 is moved to the insertion position and the retreat position by, for example, a folding blade driver 751. The folding blade driver 751 may have various structures. In an example, the folding blade driver 751 may have a slider-crank structure.

The folding blade driver 751 may include a rotating member 751-2 that is rotated by a first motor 751-1, a linearly movable slider 751-3, and a crank 751-4 for connecting the rotating member 751-2 to the linearly movable slider 751-3. The folding blade 750 is provided on the linearly movable slider 751-3. The controller 800 may move the folding blade 750 to the insertion position and the retreat position by driving the first motor 751-1. Although not shown in the drawings, the folding blade driver 751 may include the linearly movable slider 751-3 provided with the folding blade 750 and a linear motor (not shown) for driving the linearly movable slider 751-3. In FIG. 2, the folding blade 750 is linearly moved to the insertion position and the retreat position, but the folding blade 750 may be rotated to the insertion position and the retreat position.

The positioning member 740 supports the leading edge PF of the sheet P fed along the folding path 710 and aligns the sheet P at an initial folding position. The positioning member 740 is moved to the alignment position (solid lines in FIG. 2) for supporting the leading edge PF of the sheet P on the folding path 710 and aligning the sheet P and to the folding position (dashed lines in FIG. 2) where a folding position of the sheet P is adjusted to a position corresponding to the folding nip N. The leading edge PF of the sheet P fed along the folding path 710 is supported on the positioning member 740 located at the alignment position. The positioning member 740 is moved to the alignment position and the folding position by a lifting member 741. The folding position includes at least an initial folding position of the sheet P. The folding position may include second and subsequent folding positions. A position of the positioning member 740 may be detected by a position detection sensor (not shown). The lifting member 741 may include a third motor 742. The third motor 742 may be, for example, a linear motor. The third motor 742 may be a rotating motor. In this case, the lifting member 741 may be implemented by various structures such as a combination of a rotating motor and a linear movement device, a combination of the rotating motor and a rotating belt or chain, and the like.

With the above-described configuration, it is possible to fold the sheet P once. For example, a single sheet or a plurality of sheets P discharged from the printer 100 are fed along the folding path 710 so that the leading edge PF thereof is supported by the positioning member 740 which is located at an alignment position as shown in FIG. 2 by solid lines. As shown in FIG. 2 by dashed lines, the positioning member 740 is moved to the folding position to align the sheet P in the initial folding position. Then, the initial folding position of the sheet P is located at a position corresponding to the folding nip N. Next, a central portion of the sheet P is pushed into the folding nip N while the folding blade 750 is moved to the insertion position. Then, the sheet P is pushed into the folding nip N and folded once and then discharged to an exit of the folding nip N. The folded sheet P is discharged to the outside by a discharge roller 760. Thus, V-folding is possible. The folding position may be determined by the positioning member 740.

The sheet folding device 700 of the present example is capable of folding twice or more by using a single pair of the first and second folding rollers 721 and 722. The sheet P having passed through the folding nip N is guided back to the folding path 710 through the guide path 761 and returned to an entrance of the folding nip N. The guide path 761 may be provided around at least one of the first folding roller 721 and the second folding roller 722. In the present example, the guide path 761 is provided around the first folding roller 721. However, in other examples, the guide path can be provided around the second folding roller or around the first and the second folding rollers.

The guide member 730 is located around the first folding roller 721. The guide member 730 is movable to a first position (of FIG. 2) for discharging the sheet P that has passed through the folding nip N, the second position (of FIG. 3) for guiding the sheet P that has passed the folding nip N to the guide path 761, and the third position (of FIG. 4) for guiding the sheet P fed along the guide path 761 to the folding path 710. The guide member 730 of the present example may be rotated around the first folding roller 721 and moved to the first, second, and third positions. For example, the guide member 730 may be rotatably supported on a rotating shaft of the first folding roller 721. The guide member 730 may be rotated around the first folding roller 721 to the first, second, and third positions by a drive motor, for example, a fourth motor 739. The fourth motor 739 may be connected to the guide member 730 by a power transmitting member such as a gear, a belt, or the like. For example, the guide member 730 may be provided with a gear portion 738, and the gear portion 738 may be connected to the fourth motor 739.

The conveying roller 762 is arranged on the guide path 761. The conveying roller 762 engages with any one of the pair of folding rollers, for example, the first folding roller 721 to form a conveying nip N2. The conveying roller 762 is driven to be rotate by the first folding roller 721 to feed the sheet P along the guide path 761. The conveying roller 762 of the present example may be rotated around the first folding roller 721. In an example, the conveying roller 762 may be rotatably located on the guide member 730. With this configuration, the conveying roller 762 may be rotated around the first folding roller 721 by the fourth motor 739. The conveying roller 762 may be moved by the fourth motor 739 to a position (of FIG. 3) close to the exit of the folding nip N and a position (of FIG. 4) close to the entrance of the folding nip N.

The guide member 730 may include a first guide portion 731 for selectively guiding the sheet P to the guide path 761 at the first position and the second position, and a second guide portion 732 for guiding the sheet P to the folding path 710. The first guide portion 731 is located at the exit side of the folding nip N and the second guide portion 732 is located at the entrance side of the folding nip N with respect to the conveying roller 762. The first guide portion 731 and the second guide portion 732 may be connected to each other by a third guide portion 733. As shown in FIG. 2, when the guide member 730 is located at the first position, the sheet P that has passed through the folding nip N is guided to the discharge roller 760 by the first guide portion 731 and discharged by the discharge roller 760. As shown in FIG. 3, when the guide member 730 is located at the second position, the sheet P that has passed through the folding nip N is guided to the guide path 761 by the first guide portion 731. As shown in FIG. 4, when the guide member 730 is located at the third position, the sheet P that has passed through the folding nip N and fed along the guide path 761 is guided to the folding path 710 by the second guide portion 732. Thus, the sheet P may be fed to a position for subsequent folding operations.

The sheet folding device 700 may have at least one position sensor 737 for detecting a position of the guide member 730. The position sensor 737 may be implemented by, for example, an optical sensor, a microswitch, or the like. For example, any one of the first, second, and third positions of the guide member 730, e.g., the first position, may be a reference position. The position sensor 737 may detect the guide member 730 located at the reference position. The drive motor for driving the guide member 730, that is, the fourth motor 739 may be, for example, a pulse motor. When the reference position is detected by the position sensor 737, the guide member 730 is located at the first position. The controller 800 may control a rotational direction of the fourth motor 739 and the number of drive pulses to move the guide member 730 to the second position or the third position.

When a member for selectively guiding the sheet P that has passed through the folding nip N to the guide path 761 and a member for guiding the sheet P fed along the guide path 761 to the folding path 710 are separately provided, the structure of the sheet folding device 700 becomes complicated and the assembly cost may be increased. In addition, two drive motors are used for driving these two members, respectively, so that the component cost may be increased. According to the present example, a function of selectively guiding the sheet P that has passed through the folding nip N to the guide path 761 and a function of guiding the sheet P fed along the guide path 761 to the folding path 710 may be implemented by one guide member 730 and the fourth motor 739. Therefore, the number of components and the number of assembling processes may be reduced, and the manufacturing cost of the sheet folding device 700 may be reduced. Further, since the conveying roller 762 is provided on the guide member 730, the conveying roller 762 may be moved by the fourth motor 739. Therefore, the manufacturing cost of the sheet folding device 700 may be further reduced.

Although not shown in the drawings, a guide member that is spaced apart from an outer periphery of the first folding roller 721 and forms the guide path 761 is employed in the sheet folding device 700 and the conveying roller 762 may be located at a fixed position. In this configuration, since a moving path of the sheet P is not uniform between the exit and the entrance of the folding nip N, a length of moving path of the sheet P between the exit and the entrance of the folding nip N may vary. For accurate subsequent folding of the sheet P, moving distances of the sheet P between the exit and the entrance of the folding nip N need to be constant. It is difficult to align folding positions of the sheet P with the folding blade 750 unless the moving distances of the sheet P between the exit and the entrance of the folding nip N is constant. A method of arranging a plurality of conveying rollers 762 in a fixed position along the guide path 761 may be considered, but in this case, the component cost may be increased. Furthermore, a skew of the sheet P may be generated as the sheet P is bent when the sheet P enters a plurality of conveying nips formed by the plurality of conveying rollers 762 and the first folding roller 721. Further, since the guide member extends from the exit of the folding nip N to the entrance of the folding nip N around the first folding roller 721, it is not easy to remove a jam when the jam occurs in the guide path 761. In order to remove the jam, the guide member needs to be partially or wholly separated to expose the guide path 761.

According to the present example, the conveying roller 762 may be rotated around the first folding roller 721 and moved to the position (of FIG. 3) close to the exit of the folding nip N and the position (of FIG. 4) close to the entrance of the folding nip N. For example, as shown in FIG. 3, when the leading edge of the sheet P guided to the guide path 761 through the folding nip N is engaged with the conveying nip N2, the conveying roller 762 may be rotated around the first folding roller 721 in accordance with rotational linear velocity of the first folding roller 721 and moved toward the entrance of the folding nip N. According to this configuration, since the sheet P is fed in close contact with the first folding roller 721 between the entrance and the exit of the folding nip N, the feeding of the sheet P between the entrance and the exit of the folding nip N is almost constant. Therefore, accurate subsequent folding of the sheet P is possible.

Also, since the conveying roller 762 is rotated around the first folding roller 721 and moved toward the exit of the folding nip N while the sheet P is engaged with the conveying nip N2 formed by the conveying roller 762 and the first folding roller 721, the possibility of occurrence of a skew may be reduced.

Further, since the guide member 730 itself may move between the entrance and the exit of the folding nip N, the guide path 761 is always partially exposed. Therefore, when a jam occurs, the jam treatment is easy.

Furthermore, when the conveying roller 762 has a fixed position, a minimum folding length is limited by the distance from the exit of the folding nip N to the folding nip N. The minimum folding length may be shortened by bringing the conveying roller 762 close to the exit of the folding nip N, but the variability of a length of the moving path of the sheet P between the exit and entrance of the folding nip N may become larger. Thus, it is necessary to arrange the plurality of conveying rollers 762 around the first folding rollers 721. When the conveying roller 762 is moved away from the exit of the folding nip N, the minimum folding length may not be shortened. According to the present example, it is possible to change a position of the conveying roller 762 in a state in which the conveying nip N2 is formed, so that even when the minimum number of conveying rollers 762, for example, one conveying roller 762 is employed, the minimum folding length may be relatively shorter.

Figure 6:
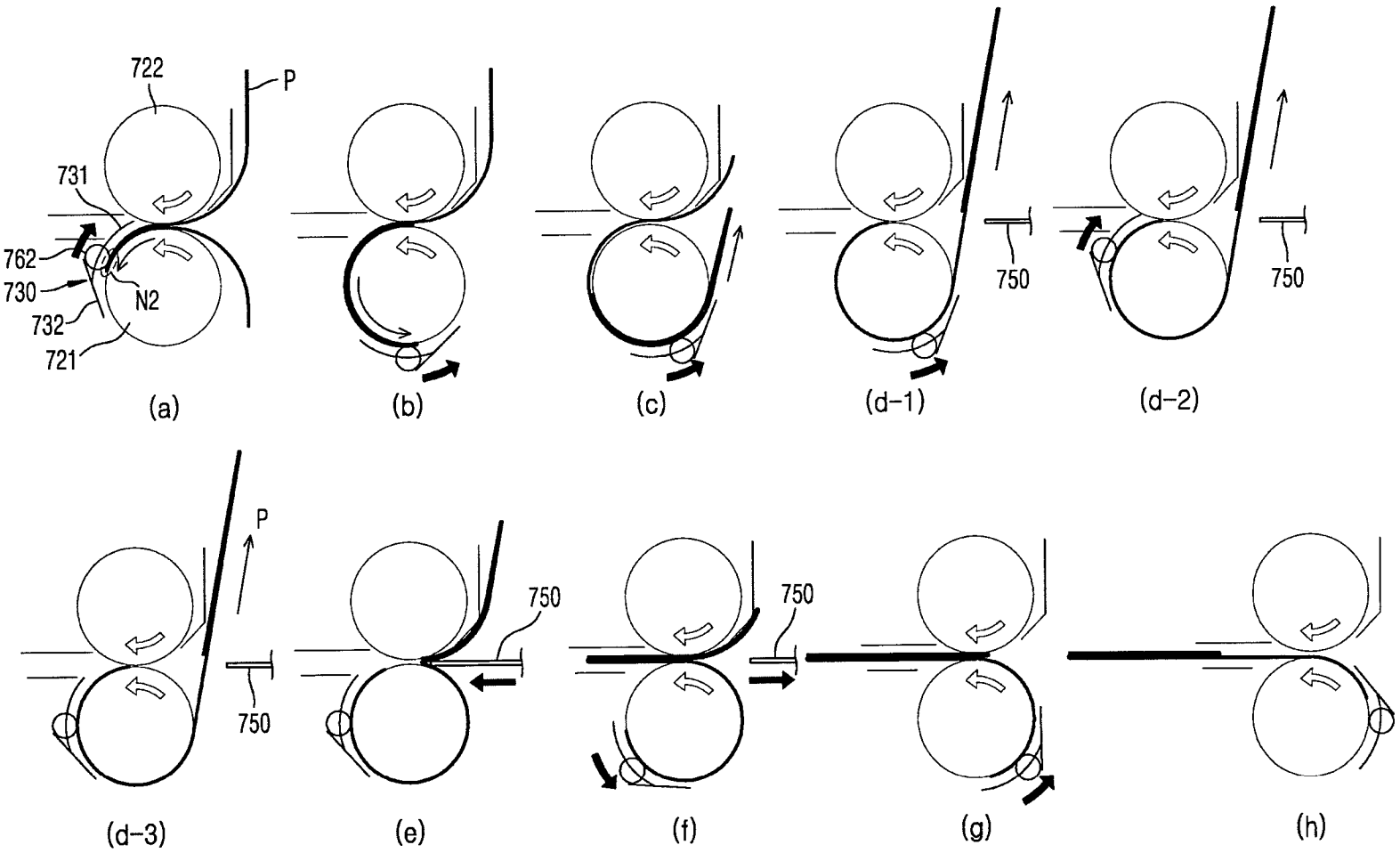
FIG. 6 is a view of an example of Z-folding.

FIG. 6 is a view of an example of Z-folding. FIG. 6 schematically shows the first and second folding rollers 721 and 722, the folding blade 750, the guide member 730, and the conveying roller 762. With reference to FIGS. 2 to 6, the Z-folding will be described as an example of folding twice by the above-described configuration.

Not shown in FIG. 6, the positioning member 740 is located at an alignment position. The sheet P discharged from the printer 100 is fed along the folding path 710. The leading edge PF of one sheet P or a plurality of sheets P is supported by the positioning member 740 located at the alignment position, and a skew is corrected. The positioning member 740 is moved to a folding position where a ⅓ L point of the sheet P is located at the entrance side of the folding nip N. Then, the folding blade 750 is moved to an insertion position, and the ⅓ L point of the sheet P is pushed into the folding nip N. The sheet P passes through the folding nip N and is folded at the ⅓ L point. The folding blade 750 returns to a retreat position.

Referring to FIG. 6 (*a*), the sheet P that has passed through the folding nip N is fed along the guide path 761 provided around the first folding roller 721 and returned to the entrance of the folding nip N. To this end, the controller 800 drives the fourth motor 739 to move the guide member 730 to the second position. Then, the sheet P that has passed through the folding nip N is guided to the guide path 761 by the first guide portion 731.

In FIG. 6 (*b*), when the leading edge of the folded sheet P is engaged with the conveying nip N2 formed by the conveying roller 762 and the first folding roller 721, the controller 800 drives the fourth motor 739 to rotate the guide member 730 and the conveying roller 762 in the same direction as a rotational direction of the first folding roller 721. Rotational linear velocity of the guide member 730 and the conveying roller 762 is not greater than that of the first folding roller 721. That is, the rotational linear velocity of the guide member 730 and the conveying roller 762 may be equal to or slightly less than that of the first folding roller 721. According to this configuration, the sheet P may be kept engaged with the conveying nip N2 while being moved along the guide path 761 from the exit of the folding nip N toward the entrance of the folding nip N.

When the guide member 730 reaches the third position as shown in FIG. 6 (*c*), the sheet P is guided to the folding path 710 by the second guide portion 732. In FIG. 6 (*d*-1), the guide member 730 may be held in the third position until a second folding position of the sheet P, for example, a % L point of the sheet P is located at the entrance of the folding nip N and aligned with the folding blade 750. After the sheet P is guided from the guide path 761 to the folding path 710, the guide member 730 may be returned to the second position as shown in FIG. 6 (*d*-2) or to the first position as shown in FIG. 6 (*d*-3). The conveying roller 762, when the second folding position of the sheet P is aligned with the folding blade 750, may be located at a position where the trailing edge of the sheet P that has passed through the folding nip N is held in a state of being engaged with the conveying nip N2.

The guide member 730 may be moved to the first position before the folding blade 750 is moved to an insertion position for the second folding. Then, as shown in FIG. 6 (*e*), the folding blade 750 is moved to the insertion position, and the % L point of the sheet P is pushed into the folding nip N. As the first and second folding rollers 721 and 722 are rotated, the sheet P passes through the folding nip N for the second time and is discharged by the discharge roller 760.

As shown in FIGS. 6 (*f*) and 6 (*g*), while the second folding is being performed, the guide member 730 may be rotated in the rotational direction of the first folding roller 721 such that the sheet P is held in a state of being engaged with the conveying nip N2 formed by the conveying roller 762 and the first folding roller 721. According to such a configuration, a distance between the trailing edge of the sheet P and the conveying nip N2 may be kept short so as to prevent noise due to the shaking of the sheet P during a feeding process. As shown in FIG. 6 (*h*), the guide member 730 may be rotated to a position close to the entrance of the folding nip N beyond the third position such that the trailing edge of the sheet P is stably guided to the folding nip N.

As described above, Z-folding is possible. Further, simple four-folding may also be performed by folding the central portion of the folded sheet P one more time.

Figure 7:
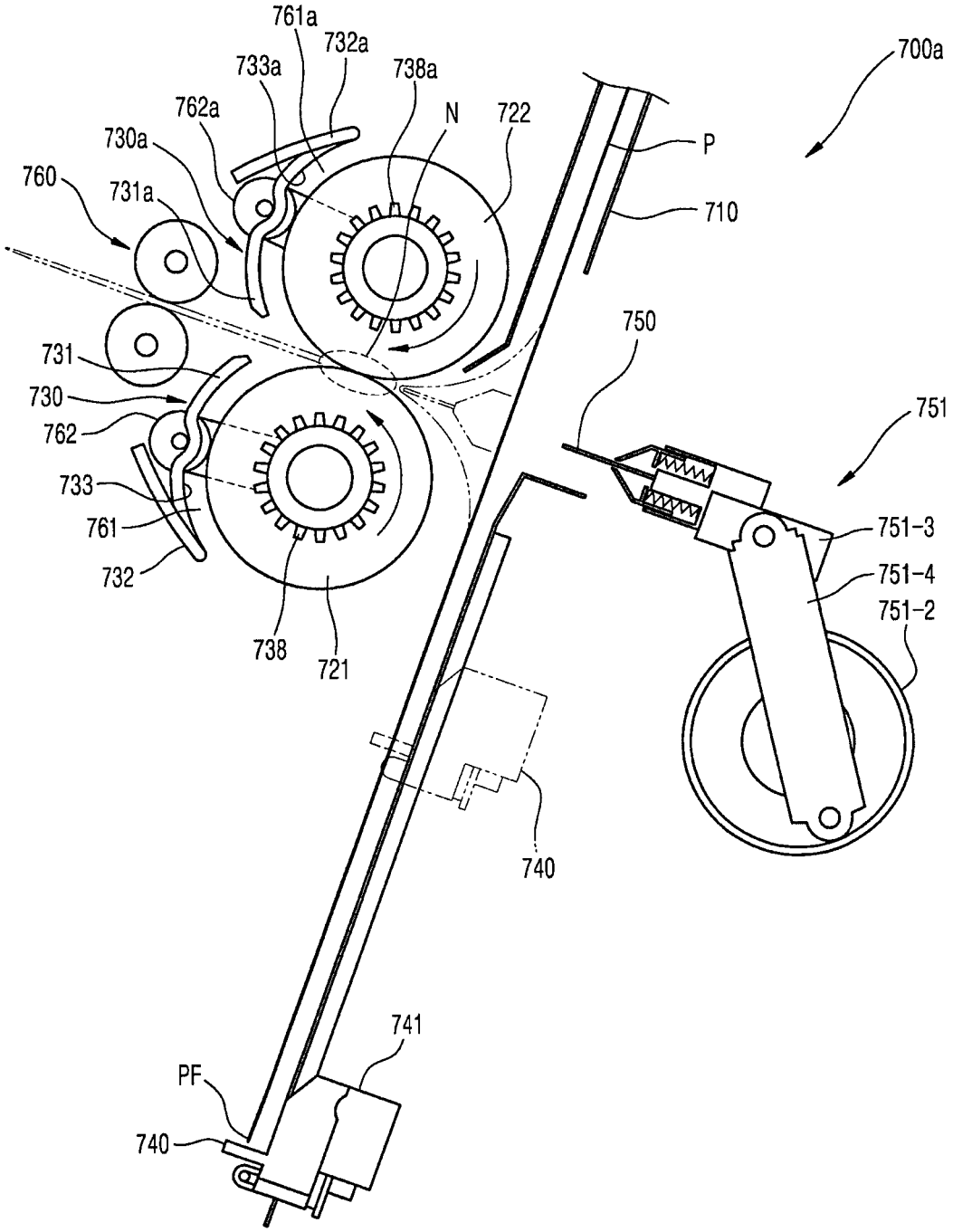
FIG. 7 is a configuration diagram of an example of a sheet folding device.

FIG. 7 is a configuration diagram of an example of a sheet folding device 700*a*. The sheet folding device 700*a* shown in FIG. 7 is different from the sheet folding device 700 shown in FIG. 2 in that a guide path 761*a*, a guide member 730*a* having first to third guide portions 731*a*, 732*a*, and 733*a*, and a conveying roller 762*a* are additionally provided around the second folding roller 722. Structures of the guide path 761*a*, the guide member 730*a*, and the conveying roller 762*a* are the same as those of the guide path 761, the guide member 730, and the conveying roller 762 described above, respectively.

C-folding or Z-folding, which is 3-folding, may be possible by folding twice using the guide path 761 or the guide path 761*a*. In addition, double gate-folding, roll-folding, W-folding, or the like is possible by folding three times while passing the sheet P sequentially through the guide path 761 and the guide path 761*a*.

Figure 8:
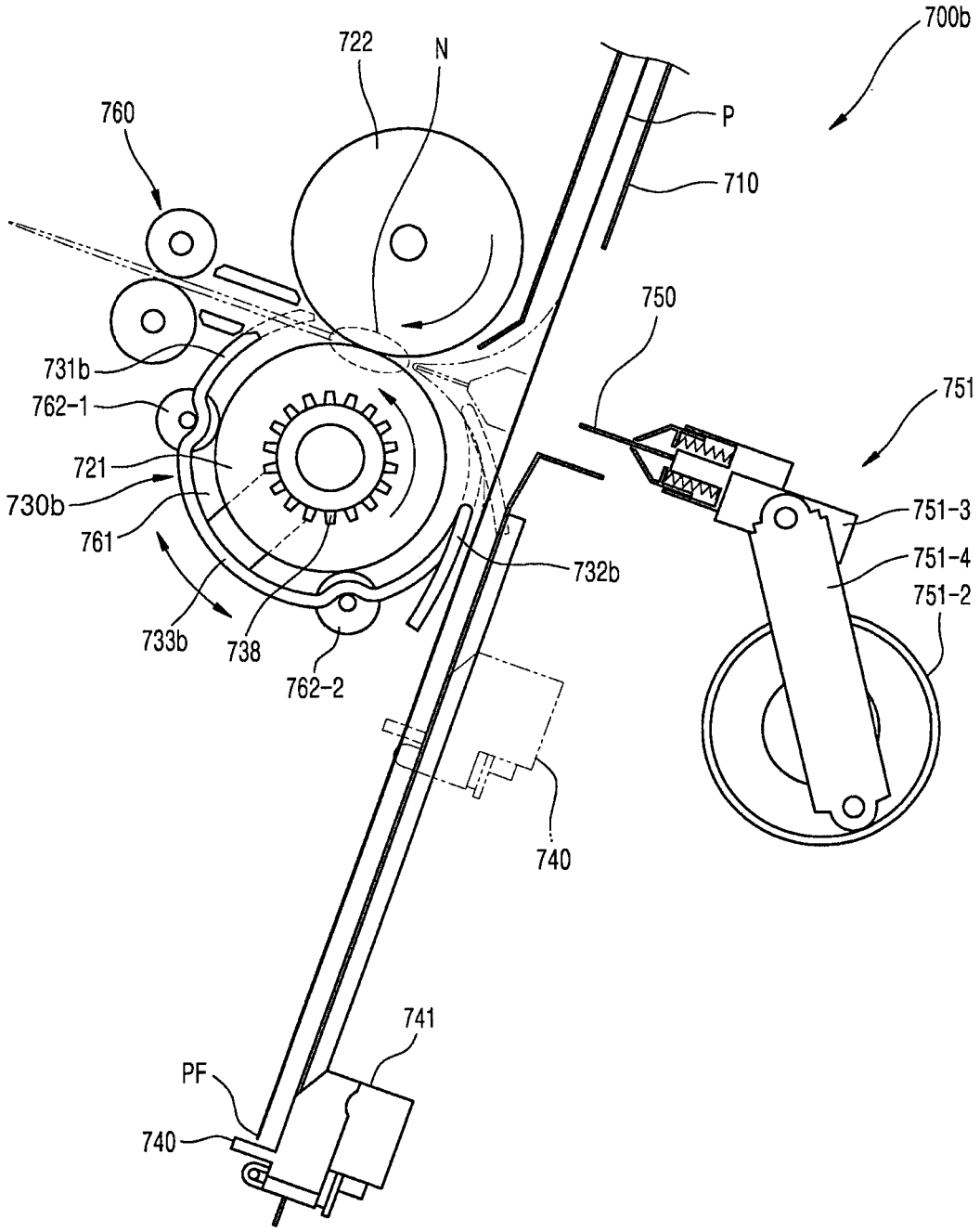
FIG. 8 is a configuration diagram of an example of a sheet folding device.

FIG. 8 is a configuration diagram of an example of a sheet folding device 700*b*. The sheet folding device 700*b* shown in FIG. 8 is different from the sheet folding device 700 shown in FIG. 2 in that first and second conveying rollers 762-1 and 762-2 are located at the exit side and the entrance side of the folding nip N, respectively, and a guide member 730*b* extends from a position adjacent to the exit of the folding nip N to a position adjacent to the entrance of the folding nip N. The first and second conveying rollers 762-1 and 762-2 are rotatably located on the guide member 730*b*. Movement of the guide member 730*b* to the first, second, and third positions by the fourth motor 739 through the gear portion 738 is the same as that of the sheet folding device 700 shown in FIG. 2.

The guide member 730*b* may include a first guide portion 731*b* which is located on the exit side of the folding nip N with respect to the first conveying roller 762-1 and selectively guides the sheet P to the guide path 761 at the first position (the position shown by solid lines in FIG. 8) and at the second position (the position shown by dashed lines in FIG. 8). At the first position of the guide member 730*b*, the sheet P that has passed through the folding nip N is guided to the discharge roller 760. At the second position of the guide member 730*b*, the sheet P that has passed through the folding nip N is guided to the guide path 761 by the first guide portion 731*b*. The guide member 730*b* may include a second guide portion 732*b* located on the entrance side of the folding nip N with reference to the second conveying roller 762-2 and guiding the sheet P to the folding path 710 at the third position of the guide member 730*b*, and a third guide portion 733*b* for connecting the first guide portion 731*b* to the second guide portion 732*b*. The third guide portion 733*b* is spaced outward from the first folding roller 721 to form the guide path 761 therebetween.

According to such a configuration, the function of selectively guiding the sheet P that has passed through the folding nip N to the guide path 761 and the function of guiding the sheet P fed along the guide path 761 to the folding path 710 may be implemented by one guide member 730*b* and the fourth motor 739 for driving the guide member 730*b*. Therefore, the number of components and the number of assembling processes may be reduced, and the manufacturing cost of the sheet folding device 700 may be reduced. Further, since the first and second conveying rollers 762-1 and 762-2 are provided on the guide member 730*b*, the first and second conveying rollers 762-1 and 762-2 may be moved by the fourth motor 739. Therefore, the manufacturing cost of the sheet folding device 700 may be further reduced. According to the present example, since the first and second conveying rollers 762-1 and 762-2 may be rotated to some extent around the first folding roller 721, the distance between the first and second conveying rollers 762-1 and 762-2 may be made close to each other, which may help prevent the sheet P from skewing, and the minimum folding length may be made relatively short.

Figure 9:
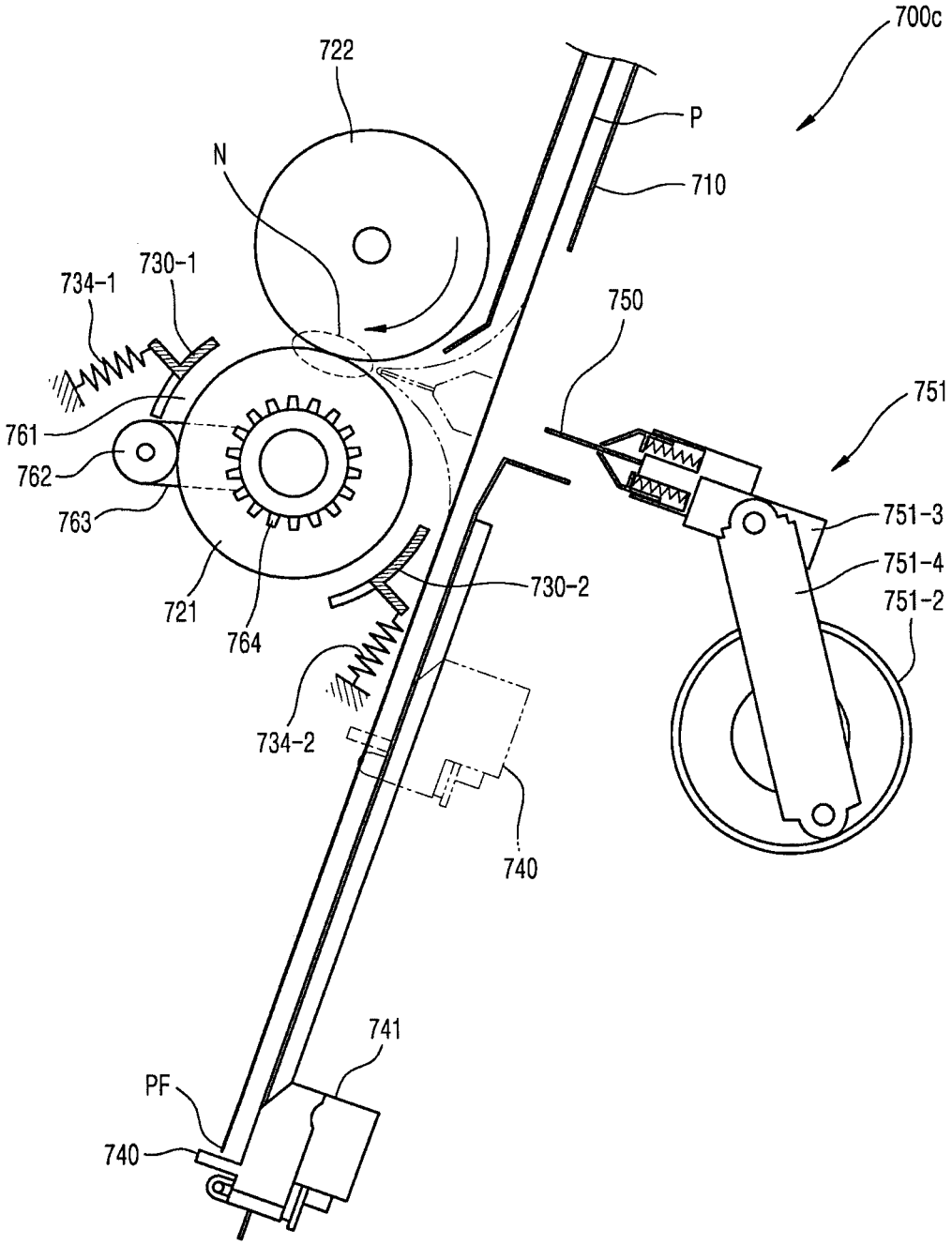
FIG. 9 is a configuration diagram of an example of a sheet folding device.
Figure 10:
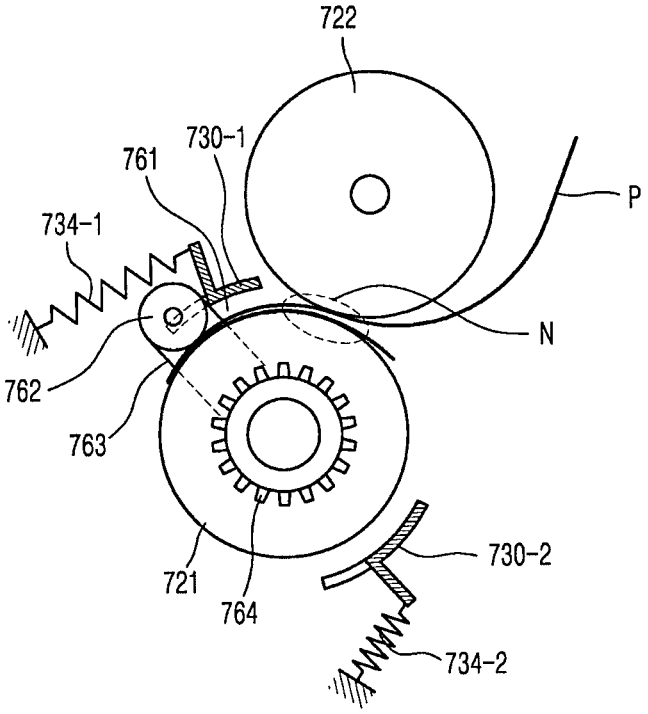
FIG. 10 is a view showing a state in which a first guide member is located at a second position in an example of the sheet folding device shown in FIG. 9.
Figure 11:
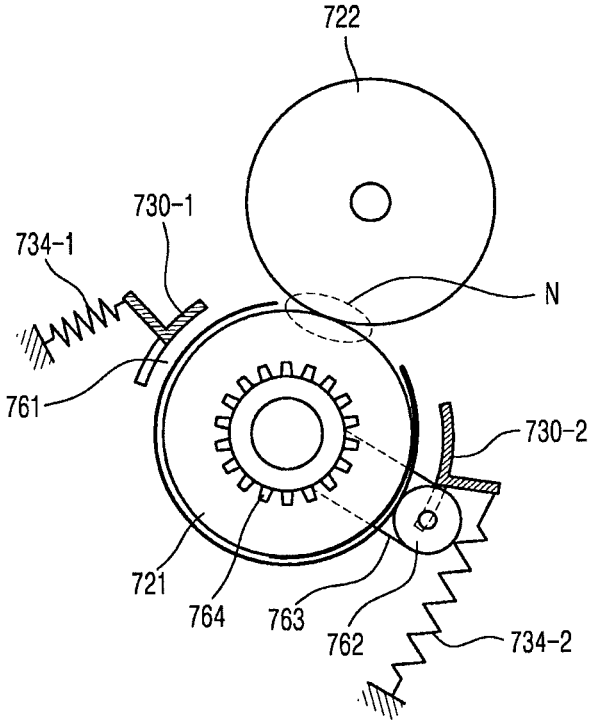
FIG. 11 is a view showing a state in which a second guide member is located at a fourth position in an example of the sheet folding device shown in FIG. 9.

FIG. 9 is a configuration diagram of an example of a sheet folding device 700*c*. FIG. 10 is a view showing a state in which a first guide member 730-1 is located at the second position. FIG. 11 is a view showing a state in which a second guide member 730-2 is located at the fourth position.

Referring to FIG. 9, the conveying roller 762 is rotatably located around the first folding roller 721. The sheet folding device 700*c* may include the first guide member 730-1 which is movable from the first position for discharging the sheet P that has passed through the folding nip N to the second position for guiding the sheet P that has passed through the folding nip N to the guide path 761 in conjunction with the rotation of the conveying roller 762, a first elastic member 734-1 for providing the first guide member 730-1 with an elastic force at the first position, and the second guide member 730-2 having a third position for guiding the sheet P fed along the guide path 761 around the first folding roller 721 to the folding path 710. The second guide member 730-2 may be fixedly located at the third position.

For example, the first guide member 730-1 may be rotated around the first folding roller 721 and moved to the first and second positions. The first elastic member 734-1 may be implemented by a tension coil spring, for example, as shown in FIG. 9. The conveying roller 762 may be rotatably located on, for example, a rotation bracket 763 that is rotated around the first folding roller 721. For example, the rotation bracket 763 may be rotatably supported on the rotating shaft of the first folding roller 721. The rotation bracket 763 may be rotated by a drive motor, for example, the fourth motor 739 (of FIG. 5). The fourth motor 739 may be connected to the rotation bracket 763 by a power transmitting member such as a gear, a belt, or the like. For example, the rotation bracket 763 may be provided with a gear portion 764, and the gear portion 764 may be connected to the fourth motor 739.

A position of the conveying roller 762 may be indirectly detected by detecting the position of the first guide member 730-1. The position sensor 737 (of FIG. 5) detects the position of the first guide member 730-1. The position sensor 737 may be implemented by, for example, an optical sensor, a microswitch, or the like. For example, any one of the first and second positions of the first guide member 730-1, e.g., the first position, may be a reference position. The position sensor 737 may detect the first guide member 730-1 located at the reference position. The drive motor for driving the rotation bracket 763, that is, the fourth motor 739, may be, for example, a pulse motor.

When the reference position is detected by the position sensor 737, the first guide member 730-1 is located at the first position. The controller 800 drives the fourth motor 739, for example, in a forward direction, to rotate the rotation bracket 763, for example, in a clockwise direction. When the rotation bracket 763 pushes the first guide member 730-1 and the first guide member 730-1 is moved to the second position beyond the first position, the position of the conveying roller 762 may be indirectly detected by the position sensor 737. By setting the number of drive pulses between the first position and the second position in advance, the rotation bracket 763 may be rotated to move the first guide member 730-1 from the first position to the second position.

The sheet P that has passed through the folding nip N may be guided to the guide path 761 by the first guide member 730-1 located in the second position. In this state, the controller 800 may drive the fourth motor 739, for example, in a reverse direction, to rotate the rotation bracket 763, for example, in a counterclockwise direction. Then, the first guide member 730-1 may be returned to the first position by the elastic force of the first elastic member 734-1.

When the leading edge of the sheet P guided to the guide path 761 is engaged with the conveying nip N2 formed by the conveying roller 762 and the first folding roller 721, the controller 800 further drives the fourth motor 739, for example, in the reverse direction, in accordance with rotational linear velocity of the first folding roller 721. The conveying roller 762 may then be rotated around the first folding roller 721 and moved toward the entrance of the folding nip N. According to this configuration, since the sheet P is fed in close contact with the first folding roller 721 between the entrance and the exit of the folding nip N, the feeding of the sheet P between the entrance and the exit of the folding nip N is almost constant. Therefore, accurate subsequent folding of the sheet P is possible. The sheet P may be stably guided to the folding path 710 by the second guide member 730-2 located at the third position.

The second guide member 730-2 may be moved from the third position to the fourth position close to the entrance of the folding nip N as shown in FIG. 11, in conjunction with the rotation of the conveying roller 762. A second elastic member 734-2 may provide the second guide member 730-2 with an elastic force at the third position.

In a state in which the leading edge of the sheet P is engaged with the conveying nip N2, the controller 800 drives the fourth motor 739 in the reverse direction in accordance with the rotational linear velocity of the first folding roller 721. The rotation bracket 763 is rotated in the counterclockwise direction and is brought into contact with the second guide member 730-2 located at the third position. When the fourth motor 739 is further driven in the reverse direction in this state, the second guide member 730-2 may be pushed by the rotation bracket 763 and further moved toward the entrance of the folding nip N. According to such a configuration, as shown in FIG. 6 (*h*), the second guide member 730-2 may be rotated to the fourth position closer to the entrance of the folding nip N such that the trailing edge of the sheet P is stably guided to the folding nip N, and the conveying roller 762 may stably feed the sheet P to a position closer to the entrance of the folding nip N.

When the fourth motor 739 is again driven in the forward direction, the conveying roller 762 may be rotated in the clockwise direction and the second guide member 730-2 may be returned to the third position by the elastic force of the second elastic member 734-2.

The above-described examples are merely illustrative, and various modifications and equivalent other examples may be made by one of skill in the art. Therefore, the scope of the present disclosure is defined not by the detailed description of the present disclosure but by the appended claims.

What is claimed is:

1. A sheet folding device comprising:

a folding path;

a positioning member to support a leading edge of a sheet fed along the folding path and to align the sheet at an initial folding position;

a first folding roller;

a second folding roller, the first folding roller to engage with the second folding roller to form a folding nip;

a folding blade to move to an insertion position to push the sheet on the folding path into the folding nip;

a guide path provided around the first folding roller to return the sheet that has passed through the folding nip to the folding path; and a conveying roller to partially rotate around the first folding roller and to engage with the first folding roller to form a conveying nip and to feed the sheet along the guide path.

2. The sheet folding device of claim 1, further comprising:

a guide member rotatable around the first folding roller to a first position to discharge the sheet that has passed through the folding nip, to a second position to guide the sheet that has passed the folding nip to the guide path, and to a third position to guide the sheet fed along the guide path to the folding path.

3. The sheet folding device of claim 2, wherein the conveying roller is rotatably located on the guide member.

4. The sheet folding device of claim 3, further comprising:

a position sensor to detect a position of the guide member; and a drive motor to rotate the guide member and the conveying roller around the first folding roller.

5. The sheet folding device of claim 1, wherein the conveying roller comprises a first conveying roller located at an exit side of the folding nip, and a second conveying roller located at an entrance side of the folding nip.

6. The sheet folding device of claim 5, wherein the guide member comprises:

a first guide portion located on the entrance side of the folding nip with respect to the first conveying roller to selectively guide the sheet to the guide path at the first position and the second position;

a second guide portion located on the exit side of the folding nip with respect to the second conveying roller to guide the sheet to the folding path at the third position; and a third guide portion to connect the first guide portion to the second guide portion and to form the guide path between the third guide portion and the first folding roller.

7. The sheet folding device of claim 1, further comprising:

a first guide member to move from a first position to discharge the sheet that has passed through the folding nip to a second position to guide the sheet that has passed through the folding nip to the guide path in conjunction with the rotation of the conveying roller;

a first elastic member to provide the first guide member with an elastic force at the first position; and a second guide member having a third position to guide the sheet fed along the guide path to the folding path.

8. The sheet folding device of claim 7, further comprising:

a second elastic member to provide the second guide member with an elastic force at the third position, wherein the second guide member, in conjunction with the rotation of the conveying roller, is to move from the third position to a fourth position closer to an entrance of the folding nip.

9. The sheet folding device of claim 8, further comprising:

a rotation bracket on which the conveying roller is rotatably located and is to rotate around the first folding roller, wherein the first guide member is to move from the second position to the first position by the rotation bracket, and the second guide member is to move from the third position to the fourth position by the rotation bracket.

10. A sheet folding device comprising:

a folding path;

a positioning member to support a leading edge of a sheet fed along the folding path and to align the sheet at an initial folding position;

a first folding roller;

a second folding roller, the first folding roller to engage with the second folding roller to form a folding nip;

a folding blade to move to an insertion position to push the sheet on the folding path into the folding nip;

a guide path provided around the first folding roller to return the sheet that has passed through the folding nip to the folding path;

a guide member which forms the guide path between an outer periphery of the first folding roller and the guide member, the guide member being rotatable around the first folding roller; and a conveying roller that is rotatably located on the guide member and is to engage with the first folding roller to form a conveying nip and is to feed the sheet along the guide path.

11. The sheet folding device of claim 10, wherein the guide member has a first position to discharge the sheet that has passed through the folding nip, a second position to guide the sheet that has passed the folding nip to the guide path, and a third position to guide the sheet fed along the guide path to the folding path.

12. The sheet folding device of claim 11, further comprising:

a position sensor to detect a position of the guide member; and a drive motor to rotate the guide member and the conveying roller around the first folding roller.

13. The sheet folding device of claim 10, wherein the conveying roller comprises a first conveying roller located at an exit side of the folding nip and a second conveying roller located at an entrance side of the folding nip.

14. The sheet folding device of claim 13, wherein the guide member comprises:

a first guide portion which is located on the entrance side of the folding nip with respect to the first conveying roller and to selectively guide the sheet to the guide path at the first position and the second position;

a second guide portion which is located on the exit side of the folding nip with respect to the second conveying roller and to guide the sheet to the folding path at the third position; and a third guide portion to connect the first guide portion to the second guide portion and to form the guide path between the third guide portion and the folding roller.

15. The sheet folding device of claim 10, further comprising:

a position sensor to detect a position of the guide member; and a drive motor to rotate the guide member and the conveying roller around the first folding roller.

* * * * *